US007017470B2

(12) United States Patent
Cheong

(10) Patent No.: US 7,017,470 B2
(45) Date of Patent: Mar. 28, 2006

(54) FLOW CONTROL APPARATUS FOR CONSTRUCTION HEAVY EQUIPMENT

(75) Inventor: Hae Kyun Cheong, Pusan (KR)

(73) Assignee: Volvo Construction Equipment Holding Sweden AB, Eskilstuna (SE)

( * ) Notice: Subject to any disclaimer, the term of this patent is extended or adjusted under 35 U.S.C. 154(b) by 0 days.

(21) Appl. No.: 10/869,403

(22) Filed: Jun. 16, 2004

(65) Prior Publication Data

US 2005/0183571 A1 Aug. 25, 2005

(30) Foreign Application Priority Data

Feb. 24, 2004 (KR) ..... 10-2004-0012334

(51) Int. Cl.
*F15B 13/04* (2006.01)

(52) U.S. Cl. ..... 91/536; 91/445

(58) Field of Classification Search ..... 91/508, 91/536, 445, 446, 447, 448
See application file for complete search history.

(56) References Cited

U.S. PATENT DOCUMENTS

| | | | | |
|---|---|---|---|---|
| 2,954,011 | A * | 9/1960 | Krehbiel | 91/446 |
| 3,313,316 | A * | 4/1967 | Thomas | 91/437 |
| 5,006,033 | A | 4/1991 | McConnell | |
| 2003/0115878 | A1 | 6/2003 | Joung | |

* cited by examiner

*Primary Examiner*—Edward K. Look
*Assistant Examiner*—Igor Kershteyn
(74) *Attorney, Agent, or Firm*—Ladas & Parry LLP

(57) ABSTRACT

Disclosed is a flow control apparatus for construction heavy equipment capable of maintaining constant set flow rate regardless of changes in load pressure and pump pressure. The flow control apparatus is composed of a control valve, a flow control valve, and a load check valve. The control valve has a parallel passage, a housing provided with a first load passage and a second load passage, and a control spool provided to be movable in the housing. The flow control valve having a logic check valve provided to be openable between the first load passage and the parallel passage, and a logic control valve controlling a flow rate supplied to a back pressure chamber of the logic check valve. The load check valve is provided between the second load passage and the parallel passage to restrict backflow from the second hydraulic cylinder.

4 Claims, 3 Drawing Sheets

FLOW CONTROL APPARATUS FOR CONSTRUCTION HEAVY EQUIPMENT

BACKGROUND OF THE INVENTION

1. Field of the Invention

The present invention relates to a flow control apparatus for construction heavy equipment, in which a flow control valve and a directional control valve is provided in a block of the main control valve, thereby performing flow control function of keeping a set flow rate constant regardless of load pressure of an working unit and pump pressure of a hydraulic pump as well as function of a directional control valve.

More particularly, the present invention relates to a flow control apparatus capable of securing stability of a hydraulic system by performing function of a check valve for preventing backflow and function of a pressure compensating flow control valve and thus, by avoiding a sharp change in flow rate and pressure supplied to the working unit even when fluctuations in load pressure of a working unit and pump pressure of a hydraulic pump take place.

2. Description of the Related Art

FIG. 1 is a hydraulic circuit diagram of a conventional flow control apparatus for construction heavy equipment.

The conventional flow control apparatus for construction heavy equipment includes a hydraulic pump 200, a hydraulic cylinder 300 which is driven by hydraulic fluid supplied from the hydraulic pump 200, a control valve 100 which is fitted in a fluid channel between the hydraulic pump 200 and the hydraulic cylinder 300 and drives the hydraulic cylinder 300 by controlling the hydraulic fluid, and a flow control valve 400(400A and 400B) which is fitted in a load passages 6A and 6B between the control valve 100 and the hydraulic cylinder 300 and controls driving speed of hydraulic cylinder 300 by restricting flow rate supplied to the hydraulic cylinder 300. Among reference numerals not described, 4 indicates a center bypass passage, 500 indicates a relief valve for draining the hydraulic fluid to a tank T when a load exceeds the set pressure of the hydraulic circuit.

When a operation lever (not shown) is manipulated and thus a pilot signal pressure is applied to a right end of the control valve 100, the hydraulic fluid discharged from the hydraulic pump 200 passes through the load passage 6A via a pump passage 5, a check valve 3 and the control valve 100 switched in position, and then is supplied to a large chamber 302 of the hydraulic cylinder 300. The hydraulic fluid discharged from a small chamber 301 of the hydraulic cylinder 300 is returned to the tank T via another check valve 405B and the load passage 6B, so that the hydraulic cylinder 300 is driven for extension.

On the other hand, the control valve 100 is switched to the right, the hydraulic fluid discharged from the hydraulic pump 200 is supplied to the small chamber 301 of the hydraulic cylinder 300, so that the hydraulic cylinder is contracted.

When it is intended to control the driving speed of the hydraulic cylinder 300 by restricting the flow rate supplied to the hydraulic cylinder 300 according to a working condition, the flow rate introduced into the large chamber 302 is controlled by the difference between the pilot pressure 403A corresponding to an amount in which a throttle 401A is opened and the spring force preset by a valve spring 404A.

However, according to the conventional flow control apparatus, in order to fit the flow control valve 400 in a fluid channel between the load passages 6A and 6B of the control valve 100 and the hydraulic cylinder 300, a separate block is required, so that the number of components is increased, and thus a cost price is increased. Further, the design is limited because of the interference of the installation positions between the components.

In addition, the conventional flow control valve 400 is not provided with a check function capable of coping with the case that load pressure on the side of the hydraulic cylinder 300 is higher than discharge pressure on the side of the hydraulic pump 200, so that the check valve 3 must be separately fitted in a pump passage 5 of the control valve 100.

SUMMARY OF THE INVENTION

To solve the foregoing problems, the present invention provides a flow control apparatus for construction heavy equipment which is provided with a flow control valve and a directional control valve in a block of a main control valve and performs flow control function together with directional control valve function.

It is another objective to provide a flow control apparatus for construction heavy equipment, in which a main flow control valve and a directional control valve is provided in a block of a control valve, thereby reducing the number of components to save a cost price, and removing interference of installation position between the components to enable free design, so that the flow control apparatus can be provided in a narrow space.

To achieve the above objective, the present invention provides a flow control apparatus for construction heavy equipment, in which a flow control valve and a directional control valve is provided in a block of a main control valve so as to perform a flow control function and a function of a directional control valve.

The flow control apparatus for construction heavy equipment comprises a control valve having a parallel passage to which hydraulic fluid of a hydraulic pump is supplied, a housing provided with a first load passage discharging the hydraulic fluid of the parallel passage to a first hydraulic cylinder and a second load passage discharging the hydraulic fluid to a second hydraulic cylinder, and a control spool provided to be movable in the housing and selectively communicating any one of the first and second load passages with the parallel passage. A flow control valve has a logic check valve provided to be openable between the first load passage and the parallel passage, and a logic control valve provided between the parallel passage and the logic check valve to control flow rate of hydraulic fluid supplied to a back pressure chamber of the logic check valve. And, a load check valve is provided between the second load passage and the parallel passage to restrict backflow from the second hydraulic cylinder.

Preferably, the logic control valve controls flow rate of hydraulic fluid supplied to the back pressure chamber of the logic check valve depending on a difference between pressure of the parallel passage and pressure of the first load passage to thus keep the flow rate of hydraulic fluid supplied to the first load passage constant.

Further, the logic check valve has backflow prevention function of restricting the backflow from the first load passage to the parallel passage.

BRIEF DESCRIPTION OF THE DRAWINGS

The above objects, features and advantages of the present invention will become more apparent from the following detailed description when taken in conjunction with the accompanying drawings, in which.

DETAILED DESCRIPTION OF THE PREFERRED EMBODIMENT

Figure 1:
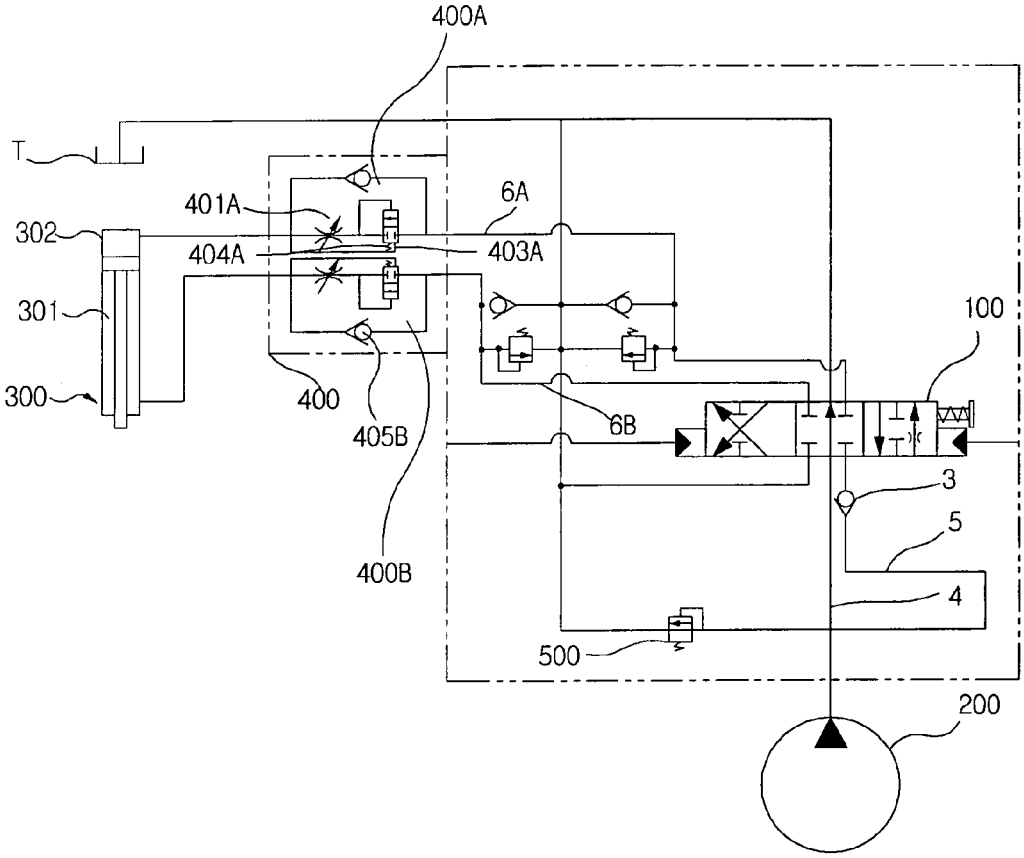
Fig.1 PRIOR ART
FIG. 1 is a hydraulic circuit diagram of a conventional flow control apparatus for construction heavy equipment.

A preferred embodiment of the present invention will now be described with reference to the accompanying drawings. In the following description, same drawing reference numerals are used for the same elements even in different drawings. The matters defined in the description such as a detailed construction and elements of a circuit are nothing but the ones provided to assist in a comprehensive understanding of the invention. Thus, it is apparent that the present invention can be carried out without those defined matters. Also, well-known functions or constructions are not described in detail since they would obscure the invention in unnecessary detail.

Figure 2:
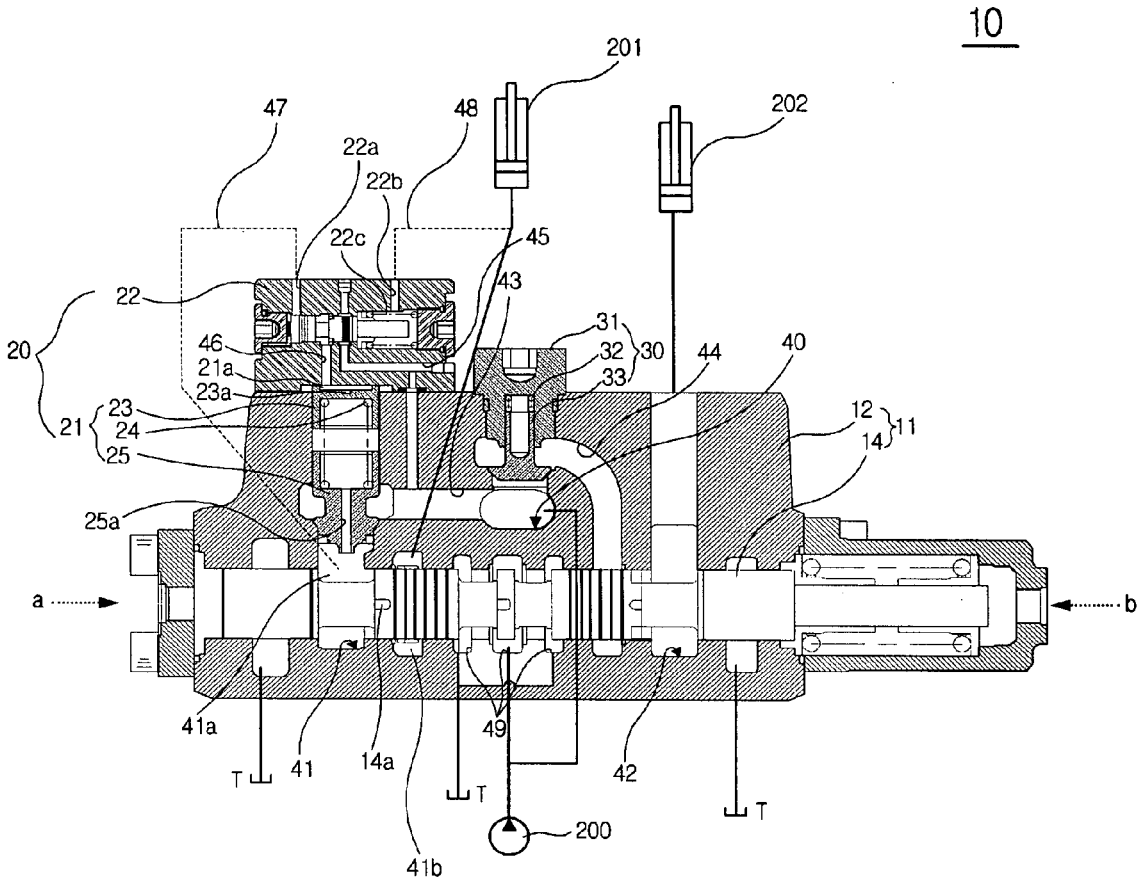
FIG. 2 is a cross-sectional view of a flow control apparatus for construction heavy equipment according to one embodiment of the present invention.

Referring to FIG. 2 showing a cross-sectional view of a flow control apparatus for construction heavy equipment according to one embodiment of the present invention, the flow control apparatus 10 includes a control valve 11 having a housing 12 and a control spool 14 provided to be movable in the housing 12, a flow control valve 20 and a load check valve 30.

The housing 12 is formed of a block where various kinds of valves and fluid channels are provided, and constructs a main body of the control valve 10. The housing 12 is provided therein with a parallel passage 40 to which hydraulic fluid of a hydraulic pump 200 is supplied, a first load passage 41 which discharges the hydraulic fluid of the parallel passage 40 to a first hydraulic cylinder 201, and a second load passage 42 which discharges the hydraulic fluid to a second hydraulic cylinder 202.

The control spool 14 is installed to be movable to the left or to the right in the housing 12. As the control spool 14 moves to the left or to the right, any one of the first and second load passages 41 and 42 is selectively communicated with the parallel passage 40.

Further, the housing 12 is provided therein with the flow control valve 20 for controlling flow rate supplied to the first hydraulic cylinder 201. The flow control valve 20 includes a logic check valve 21 and a logic control valve 22. The logic check valve 21 is installed between the first load passage 41 and the parallel passage 40 so that it can be opened or closed, while the logic control valve 22 is installed between the parallel passage 40 and the logic check valve 21.

The logic check valve 21 includes a piston 23 which is installed in the housing 12 to be movable in a vertical direction, and a logic check poppet 25 which is resiliently supported by a spring 24 and is installed to be movable relative to the piston 23. The logic check poppet 25 is installed on a first connection passage 43 connecting the parallel passage 40 and the first load passage 41 so that the first connection passage 43 can be opened or closed.

Thus, the logic check poppet 25 performs the function of connecting or disconnecting the parallel passage 40 and the first load passage 41, as well as function as a check valve which moves downward relative to the piston 23 to restrict backflow when the pressure of the first passage 41 is increased.

A back pressure chamber 21*a* is provided on an upper end of the piston 23. An orifice 23*a* is provided in a lower side of the back pressure chamber 21*a* and is communicated with the back pressure chamber 21*a*. Further, the logic check poppet 25 is provided with a logic check fluid channel 25*a*, which passes through the logic check poppet 25 and communicates the orifice 23*a* and the first load passage 41 with each other.

The logic control valve 22, which controls the flow rate supplied to the back pressure chamber 21*a* of the logic check valve 21, is installed on the housing to be movable to the left or right as a signal pressure is supplied. Thus, the logic control valve 22 moves to the left or right depending on the supplied signal to thus connect or disconnect the logic control inlet line 45 and a logic control outlet line 46, wherein the logic control inlet line 45 is connected with the first connection passage 43. Here, the logic control outlet line 46 is connected with the back pressure chamber 21*a* of the logic check valve 21. Thus, the logic control valve 22 controls the flow rate supplied from the parallel passage 40 to the back pressure chamber 21*a* of the logic check valve 21.

Further, the logic control valve 22 moves to the left or right depending on the signal pressure supplied through a pump pressure signal line 47 and a load signal line 48. The pump pressure signal line 47 senses the pressure of a supply side 41*a* of the first load passage 41, while the load signal line 48 senses the pressure of an output side 41*b* of the first load passage 41. The pump pressure signal line 47 supplies the signal pressure to a left pressure chamber 22*a* of the logic control valve 22, while the load signal line 48 supplies the signal pressure to a right pressure chamber 22*a* of the logic control valve 22.

The logic control valve 22 is resiliently supported by a spring 22*c* to the direction of the left pressure chamber 22*a*, so that it is shifted to the left or right by the difference between the signal pressure supplied to the left pressure chamber 22*a* and the signal pressure supplied to the right pressure chamber 22*b* and a spring force.

The pump pressure line 47 and load signal line 48 are connected to a tank T when the control spool 14 of the control valve 11 is in a neutral position. When the control spool 14 is switched to the left or right side by a pilot signal pressure, the signal pressures of the pump pressure and load signal lines 47 and 48 are supplied to the logic control valve 22.

The load check valve 30 is installed between the second load passage 42 and the parallel passage 40 and serves to restrict the backflow from the second hydraulic cylinder 202. The load check valve 30 is installed on a connection passage 44 connected with the parallel passage 40 so that the connection passage 44 can be opened or closed. The load check valve 30 supplies the hydraulic fluid supplied from the parallel passage 40 to the second load passage 42 via the second connection passage 44 depending on the movement of the control spool 14.

The load check valve 30 includes a poppet 33, which is inserted into a valve cap 31 fixed to the housing 12 and is installed to be movable in the vertical direction while being resiliently supported by a spring 32. Therefore, if the hydraulic fluid is supplied from the parallel passage 40 to increase the pressure, the poppet 33 moves upward to connect the parallel passage 40 and the second connection passage 44. If the load on the side of the second hydraulic cylinder 202 has increased the pressure on the side of the second load passage 42, the poppet 33 moves downward to disconnect the parallel passage 40 and the second connection passage 44, thus restricting the backflow from the second hydraulic cylinder 202.

Hereinafter, an operation of the flow control apparatus of construction heavy equipment according to the present invention will be described in detail with reference to the attached drawings.

As shown in FIG. 2, when the control spool 14 is in a neutral state, the hydraulic fluid from the hydraulic pump 200 is discharged to the tank T via a center bypass passage 49 of the control spool 14.

If the pilot signal pressure 'b' is supplied to the right side of the control spool 14, the control spool 14 moves to the left side. Then, the hydraulic fluid supplied form the hydraulic pump 200 to the parallel passage 40 pushes the poppet 33 of the load check valve 30 upward, so that the parallel passage 40 is connected with the second connection passage 44. Thus, the hydraulic fluid is supplied to the second hydraulic cylinder 202 via the second connection passage 44 and the second load passage 42, so that the second hydraulic cylinder 202 is driven.

When the pressure on the side of the second load passage 42 is increased due to the increase in the load of the second hydraulic cylinder 202 during the operation, the poppet 33 moves downward to block the connection between the parallel passage 40 and the second connection passage 44, so that the backflow from the second hydraulic cylinder 202 is restricted.

When the pilot signal pressure 'a' is supplied to the left side of the control spool 14, the control spool 14 moves to the right side, so that the supply and output sides 41*a* and 41*b* of the first load passage 41 are communicated with each other by a variable orifice 14*a* of the control spool 14. Thus, the hydraulic fluid of the parallel passage 40 is changed in the flow rate according to an opening area of the variable orifice 14*a* and is supplied to the first hydraulic cylinder 201 via the first load passage 41, so that the first hydraulic cylinder 201 is driven.

The flow control valve 20 composed of the logic check valve 21 and the logic control valve 22 performs the function of controlling the flow rate supplied to the first hydraulic cylinder 201 to a constant level. When the flow rate from the first connection passage 43 passing through the logic check poppet 25 is increased over a constant level, the pressure of the supply side 41*a* of the first load passage 41 is increased, and then the increased pressure is applied to the left pressure chamber 22*a* of the logic control valve 22 through the pump pressure signal line 47. Further, the load pressure exerted on the first hydraulic cylinder 201 is applied to the right pressure chamber 22*b* of the logic control valve 22 through the load signal line 48 connected to the output side 41*b* of the first load passage 41.

The logic control valve 22 moves to the left or right by the difference between the pressure exerted on the left pressure chamber 22*a* of the logic control valve 22 and the pressure exerted on the right pressure chamber 22*b* and the spring force of the spring 22*c*. In other words, assuming that the pressure exerted on the left pressure chamber 22*a* is represented by Pa, and its pressure receiving area by Da, the pressure exerted on the right pressure chamber 22*b* by Pb, and its pressure receiving area by Db, and the spring force by Fs, a force exerted on the left side or right side of the logic control valve 22 may be expressed as follows:

$$Pa \times Da = Pb \times Db + Fs$$

Thus, when the pressure of the supply side 41*a* is increased and thus the pressure of the left pressure chamber 22*a* is increased, the logic control valve 22 moves to the right, and the hydraulic fluid is discharged to the logic control outlet line 46 through the logic control inlet line 45 communicated with the parallel passage 40. The hydraulic fluid, which is discharged to the logic control outlet line 46, is supplied to the back pressure chamber 21*a* on an upper end of the logic check valve 21, and then to the supply side 41*a* of the first load passage 41 via the logic check fluid channel 25*a* and the orifice 23*a* communicated with the back pressure chamber 21*a*.

Here, when the flow rate of the logic control outlet line 46 is increased, the pressure of the back pressure chamber 21*a* is increased. As a result, the logic check valve 21 moves downward, and a passage area connecting the first connection passage 43 and the first load passage 41 is reduced, so that the flow rate of the supply side 41*a* of the first load passage 41 is reduced.

When the load on the side of the first hydraulic cylinder 201 is increased and then the pressure of the output side 41*b* of the first load passage 41 is increased, the pressure exerted on the right pressure chamber 22*b* through the load signal line 48 is increased. Thus, the logic control valve 22 moves to the left, and the opening area of the logic control valve 22 communicating the logic control inlet line 45 and the logic control outlet line 46 is reduced, and thus the flow rate passing through the logic control output line 46 is reduced. As a result, the pressure exerted on the back pressure chamber 21*a* on the upper end of the logic check valve 21 is reduced, and the logic check valve 21 moves upward, so that the passage connecting the parallel passage 40 and the first load passage 41 is opened. In other words, when the load on the side of the first hydraulic cylinder 201 is increased, the logic check valve 21 moves upward, and the flow rate supplied to the supply side 41*a* of the first load passage 41 is increased.

As set forth above, even when the pressure of the hydraulic pump 200 and the pressure on the side of the first hydraulic cylinder 201 are changed, the flow control valve 20 compensates the pressure change to control the flow rate supplied to the supply side 41*a* of the first load passage 41. Thus, the flow rate corresponding to the opening area of the variable orifice 14*a* of the control spool 14 can be kept constant.

Figure 3:
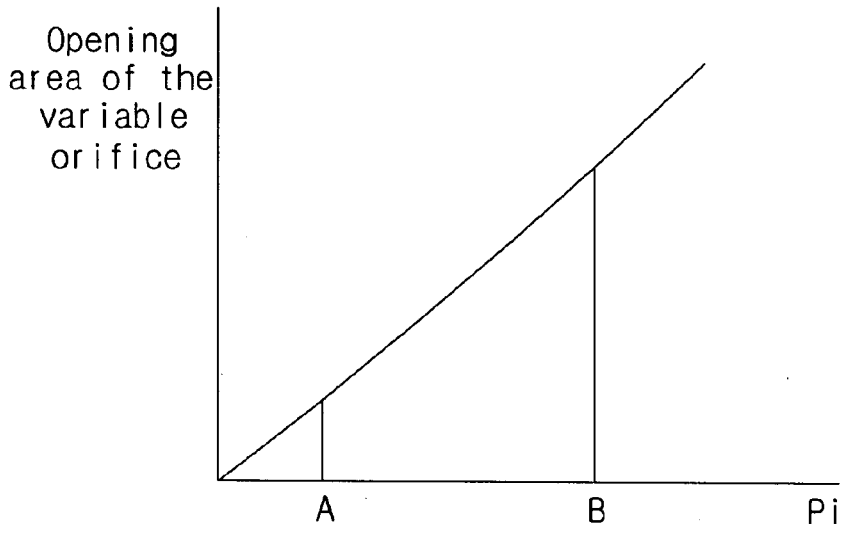
FIG. 3 shows the change rate of the opening area of the variable orifice of the control spool depending on the change of the pilot signal pressure.
Figure 4:
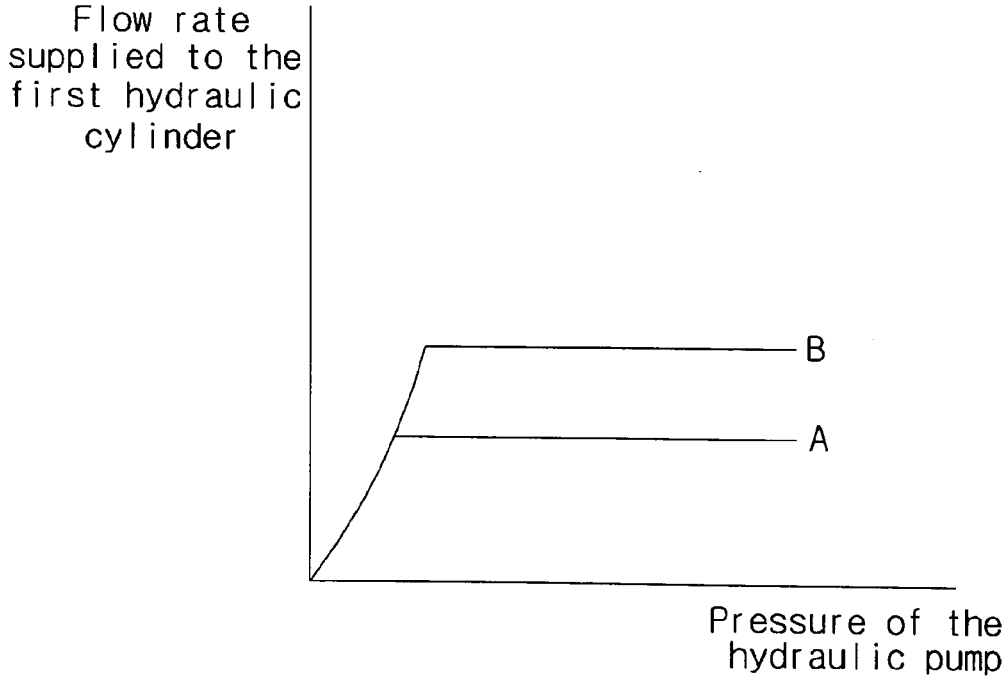
FIG. 4 shows the flow rate supplied to the first hydraulic cylinder depending on the change of the pressure of the hydraulic pump.

FIG. 3 shows the change rate of the opening area of the variable orifice of the control spool depending on the change of the pilot signal pressure, and FIG. 4 shows the flow rate supplied to the first hydraulic cylinder depending on the change of the pressure of the hydraulic pump.

When the pilot signal pressure 'a' is applied to the left side of the control spool 14, the control spool moves to the right side and the opening area of the variable orifice 14*a* is changed. For example, while the pilot signal pressure Pi is increased from A to B (A<B), the opening area of the variable orifice 14*a* is increased in proportion to the pilot signal pressure Pi.

Thus, as shown in FIG. 4, in the case that the pressure from the hydraulic pump 200 continues to increase in a state where the pilot signal pressure Pi corresponds to the point A of FIG. 3 and thus the variable orifice 14*a* is partially opened, the flow rate supplied to the first hydraulic cylinder 201 by the operation of the flow control valve 20 is kept constant.

In the case that the pressure from the hydraulic pump 200 continues to increase in a state where the pilot signal pressure Pi corresponds to the point B of FIG. 3 and thus the variable orifice 14*a* is fully opened, the flow rate supplied to the first hydraulic cylinder 201 by the operation of the flow control valve 20, is also kept constant.

In the flow control apparatus for construction heavy equipment as set forth above, the flow control valve and the directional control valve is provided in the block of the main control valve, so that the flow control apparatus can perform the flow control function as well as the function of directional control valve.

Further, because the flow control valve and the directional control valve are provided in the block of the main control valve, the number of components is reduced and the cost price is saved. In addition, the interference of installation position between the components is prevented and free design becomes possible, so that the flow control apparatus can be provided in a narrow space.

While the invention has been shown and described with reference to certain preferred embodiments thereof, it will be understood by those skilled in the art that various changes in form and details may be made therein without departing from the spirit and scope of the invention as defined by the appended claims.

What is claimed is:

1. A flow control apparatus for construction heavy equipment, comprising:

a control valve having a parallel passage to which hydraulic fluid of a hydraulic pump is supplied, a housing provided with a first load passage discharging the hydraulic fluid of the parallel passage to a first hydraulic cylinder and a second load passage discharging the hydraulic fluid to a second hydraulic cylinder, and a control spool provided to be movable in the housing and selectively communicating any one of the first and second load passages with the parallel passage;

a flow control valve having a logic check valve provided to be openable between the first load passage and the parallel passage, and a logic control valve provided between the parallel passage and the logic check valve to control flow rate of hydraulic fluid supplied to a back pressure chamber of the logic check valve; and a load check valve provided between the second load passage and the parallel passage to restrict backflow from the second hydraulic cylinder.

2. The flow control apparatus for construction heavy equipment as set forth in claim 1, wherein the logic control valve controls flow rate of hydraulic fluid supplied to the back pressure chamber of the logic check valve depending on difference between pressure of the parallel passage and pressure of the first load passage to thus keep the flow rate of hydraulic fluid supplied to the first load passage constant.

3. The flow control apparatus for construction heavy equipment as set forth in claim 1, wherein the logic check valve has backflow prevention function of restricting the backflow from the first load passage to the parallel passage.

4. The flow control apparatus for construction heavy equipment as set forth in claim 2, wherein the logic check valve has backflow prevention function of restricting the backflow from the first load passage to the parallel passage.

* * * * *